United States Patent [19]

Vermilye

[11] 4,044,550

[45] Aug. 30, 1977

[54] TURBINE WHEEL CONTAINMENT SHROUD FOR A PNEUMATICALLY POWERED TURBINE ENGINE STARTER MOTOR

[75] Inventor: Michael Lee Vermilye, Redmond, Wash.

[73] Assignee: The Boeing Company, Seattle, Wash.

[21] Appl. No.: 612,205

[22] Filed: Sept. 10, 1975

[51] Int. Cl.[2] ..... F02C 7/26; F02C 7/32

[52] U.S. Cl. ..... 60/39.09 R; 60/39.14; 415/9

[58] Field of Search ..... 60/39.09 R, 39.14, 39.5, 60/39.09 P; 415/9, 205; 416/247; 74/609

[56] References Cited

U.S. PATENT DOCUMENTS

| | | | |
|---|---|---|---|
| 2,625,047 | 1/1953 | Wood | 60/39.14 |
| 2,648,353 | 8/1953 | Haworth | 181/33 |
| 2,721,482 | 10/1955 | Shank | 60/39.14 |
| 2,959,917 | 11/1960 | McGehee | 239/265.17 |
| 2,976,012 | 3/1961 | Allen | 415/9 |
| 3,241,813 | 3/1966 | Von Flue | 415/9 |
| 3,261,228 | 7/1966 | Rothman | 74/609 |
| 3,747,622 | 10/1969 | Sieglen | 60/39.14 |

FOREIGN PATENT DOCUMENTS

| | | |
|---|---|---|
| 993,711 | 6/1965 | United Kingdom |

*Primary Examiner*—Carlton R. Croyle
*Assistant Examiner*—L. J. Casaregola
*Attorney, Agent, or Firm*—Christensen, O'Connor, Garrison & Havelka

[57] ABSTRACT

A containment shroud is attached to the exhaust outlet of a pneumatically powered turbine engine starter for containing the turbine wheel should it be inadvertently disengaged and expelled from the starter motor. The shroud includes a radially flared annularly shaped member attached to and extending outwardly or rearwardly from the exhaust outlet of the motor. A relatively massive central cylindrical member or button is positioned within the annularly shaped member adjacent the outer opening of the annularly shaped member. Four circumferentially spaced, radially outwardly extending bars tie the button to the annularly shaped member and position it adjacent the outer opening of the annularly shaped member. Should the turbine wheel dislodge from the starter motor, it will exit through the starter exhaust opening into the annular member and contact the button and inner surface of the annular member. As it does so, the rotational energy of the wheel will be dissipated via the scrubbing action of the wheel on the button, the bars and the inner surface of the annular member. When the wheel is expelled into the annular member, it will tend to block the outer opening of the annular member. Therefore, a plurality of spaced circumferential openings are located in the annular member adjacent its connection point to the starter exhaust outlet to relieve fluid pressure in a radially outward direction from within the motor if the wheel blocks the opening.

8 Claims, 4 Drawing Figures

Fig. 3
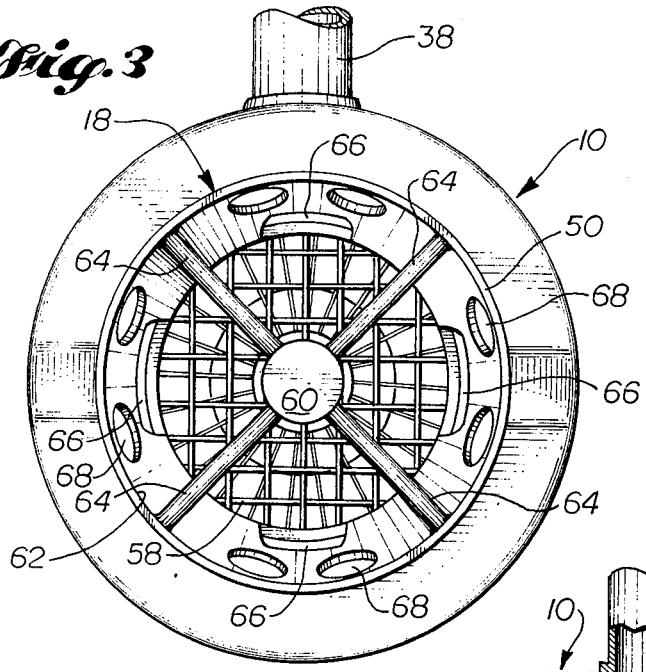
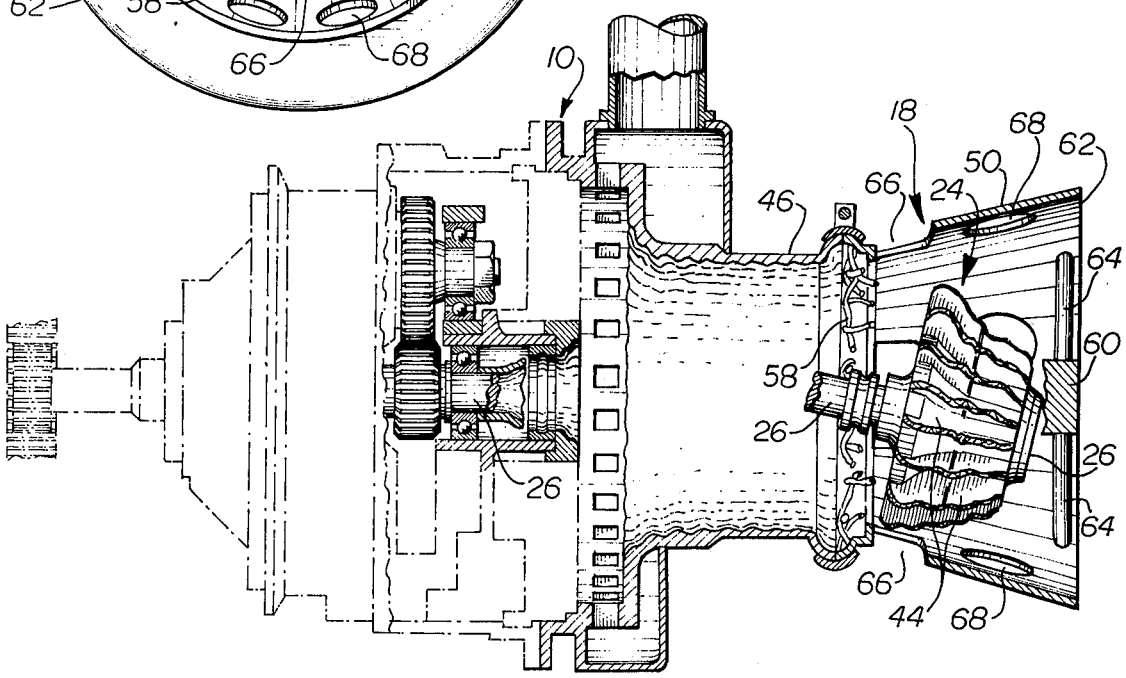
Fig. 4

TURBINE WHEEL CONTAINMENT SHROUD FOR A PNEUMATICALLY POWERED TURBINE ENGINE STARTER MOTOR

BACKGROUND OF THE INVENTION

The present invention relates to a turbine wheel containment deflector for attachment to the exhaust outlet of a fluid powered turbine engine starter motor.

Conventional turbine engines employ fluid or pueumatically powered starter motors coupled through a gear train to the turbine shaft to initially rotate the shaft of the turbine engine up to idle speed. The starter motors have a pneumatic turbine wheel housed within a turbine scroll. An exhaust duct is coupled to the scroll to direct the fluid axially rearwardly after it travels through the turbine wheel.

Occasionally pneumatic starters of this type fail as a consequence of prolonged free running of the starter turbine wheel at high rpm, on the order of 90,000 rpm. The free running condition is encountered when the starter air supply valve fails in the open position. Even though an external source of air may be cut off, most turbine engines are constructed so that bleed air from the compressor of the affected turbine engine is fed to the starter air duct. However, a properly operating air supply valve prevents the starter motor from being energized. This ducting arrangement permits cranking an engine with a previously started engine in the event an external source of air is not available. When the starter motor is exposed to the compressor bleed air, the starter will continue in a free run condition. The prolonged free run condition causes the bearings in which the turbine wheel shaft is journaled to fail. As this occurs, the turbine wheel shaft will disengage from the motor geartrain allowing the turbine wheel to move axially toward the exhaust duct within the scroll and allowing the blades of the turbine wheel to contact the interior surfaces of the scroll. The high rotational speed of the turbine wheel will cause the impeller blades to shear and melt as they contact the scroll, ultimately reducing the turbine wheel diameter sufficiently to allow it to exit through the exhaust duct. Moreover, as the turbine wheel enters the exhausted duct, fluid pressure builds up in the scroll behind the turbine wheel adding additional impetus to its axial expulsion.

When the turbine wheel is expelled through the exhaust duct, it is still rotating at a relatively high velocity. Since a turbine wheel of this type normally weighs on the order of four to five pounds, it can cause substantial damage to the surrounding turbine engine structure, nacelle structure, and adjacent equipment and personnel located on the ground. It is therefore a broad object of the present invention to provide a means by which the turbine wheel can be contained within or adjacent the pneumatic starter motor upon a failure of the type described above. An additional object of the present invention is to provide a containment means for the turbine wheel that can be attached to a pneumatic starter motor exhaust duct without modification to the duct. Further objects of the present invention are to provide a containment means that will dissipate the rotational energy of the starter turbine wheel upon failure, to provide a containment means that will not affect the normal performance characteristics of the starter motor, to provide a containment means that will relieve any air pressure increase behind a failed turbine wheel to prevent pressure buildup in the fan scroll and possible explosion of the scroll and motor housing, and to provide a simple, lightweight, turbine wheel containment means that can be installed on existing starter installations without modification or change to the starter motor.

SUMMARY OF THE INVENTION

In accordance with the foregoing objects, and other objects that will become apparent to one of ordinary skill after reading the following specification, the present invention provides a containment shroud for attachment to the exhaust outlet of a fluid powered turbine engine starter motor comprising an annularly shaped member having an inlet opening positioned adjacent the outlet of the scroll exhaust duct. The annularly shaped member extends outwardly from that location and terminates in an outer exhaust opening. The axis of the annularly shaped member is preferably oriented coaxially with the longitudinal axis of the exhaust duct. The annularly shaped member has at least one opening in its circumferential wall adjacent the outlet from the exhaust duct to relieve fluid pressure from within the annular member upon expulsion of the turbine wheel into the containment shroud. A means for blocking the outer opening from the annular member is positioned within the member adjacent the outer opening and is so oriented and constructed to permit substantial fluid flow through the outer opening while preventing egress of the turbine wheel from the shroud. In a preferred embodiment the shroud is frustoconically shaped, i.e., it flares radially outwardly as it extends axially rearwardly from the scroll exhaust duct. The blocking means preferably comprises a relatively massive cylindrical member located centrally within the annular member adjacent the outlet opening of the annularly shaped member. The cylindrical member is tied to the walls of the annularly shaped member by a plurality of circumferentially spaced, radially extending rods. As the turbine wheel is expelled through the exhaust duct it contacts the cylindrical member or button, dissipating its remaining rotational energy through frictional contact with the button, the bars, and the inner surfaces of the annularly shaped member.

BRIEF DESCRIPTION OF THE DRAWINGS

A better understanding of the present invention can be derived by reading the ensuing specification in conjunction with the accompanying drawings wherein:

FIG. 3 is an end view of the containment shroud and starter motor taken along view line 3—3 of FIG. 2; and FIG. 4 is a view similar to FIG. 2 in partial cross-section illustrating the location of a turbine wheel within the containment shroud after failure.

DESCRIPTION OF PREFERRED EMBODIMENTS

Figure 1:
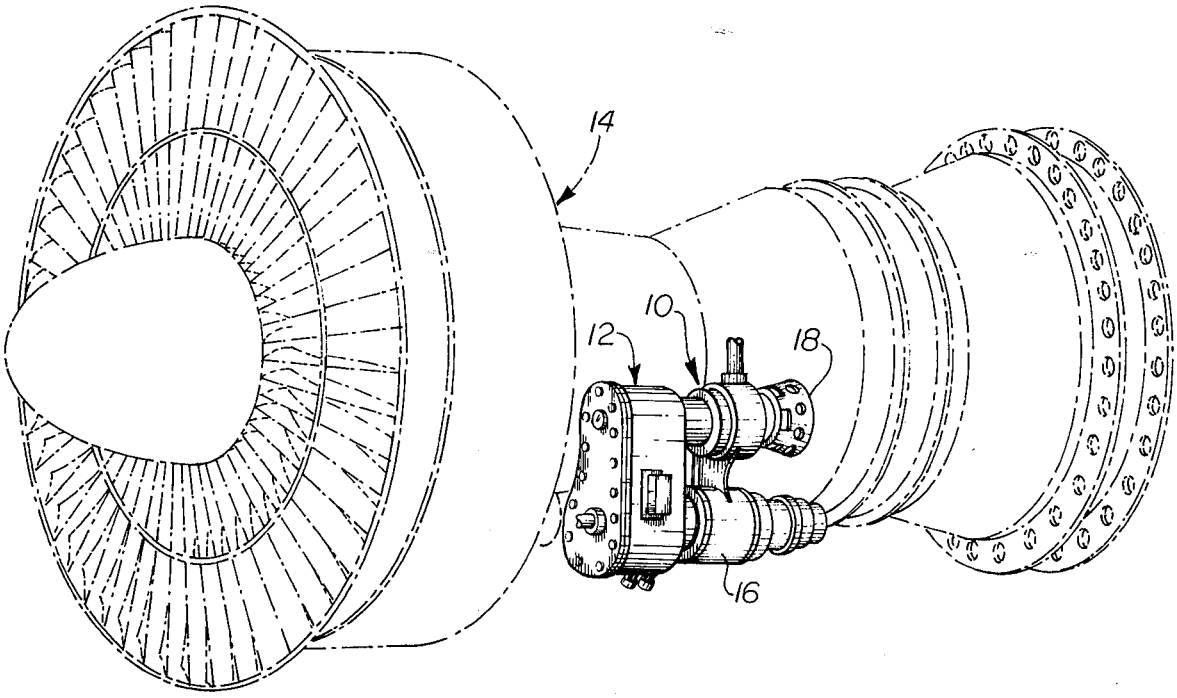
FIG. 1 is an isometric view of a turbine engine in phantom lines showing the location of a pneumatic starter motor and the containment shroud of the present invention.

Referring to FIG. 1, a conventional pneumatically powered starter motor 10 is coupled to a gear train (not shown) encased in a gear housing 12 secured to the side of a conventional turbofan jet propulsion engine 14 (shown in reference outline). Typically a generator 16 and other peripheral equipment are mounted about the turbine engine adjacent the location of the starter motor. The containment shroud 18 of the present invention is attached to and extends rearwardly from the exhaust duct of the starter motor. Without the containment shroud 18, failure of a turbine wheel resulting in its axial expulsion through the exhaust duct from the starter motor can cause substantial damage not only to the turbine engine and generator but all the surrounding equipment.

Figure 2:
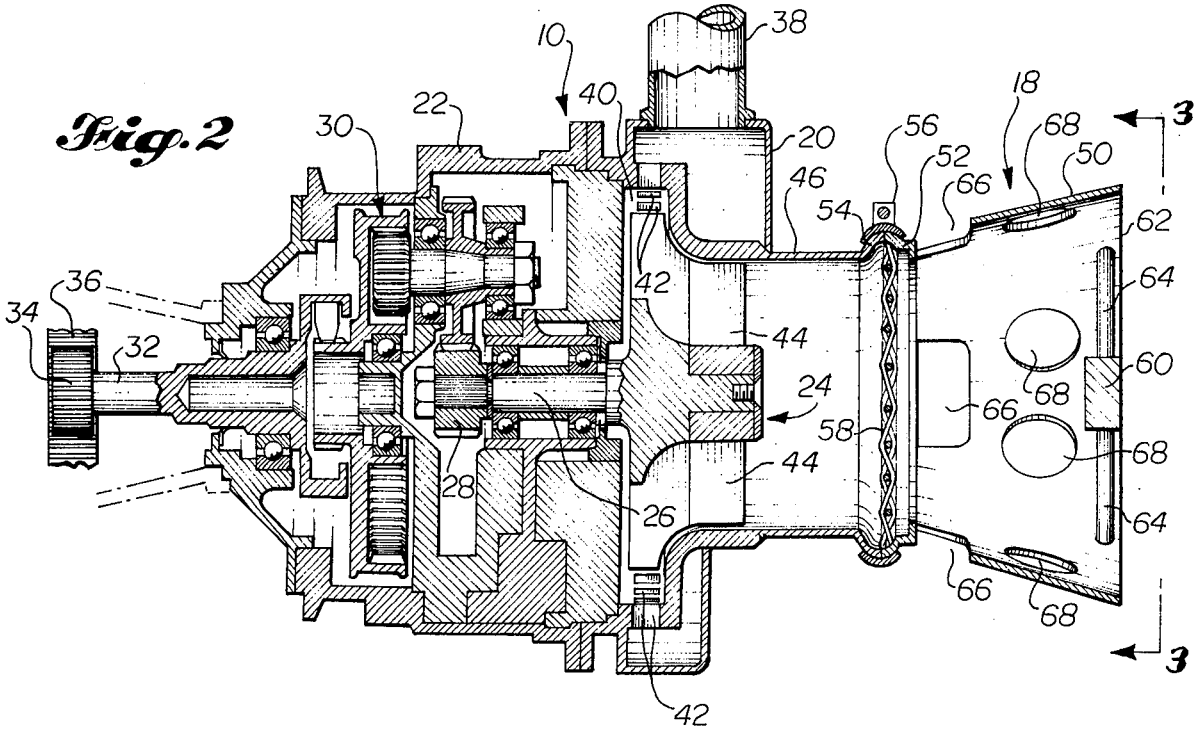
FIG. 2 is an enlarged cross-sectional view of a conventional pneumatic starter motor with the containment shroud of the present invention attached.

A typical pneumatic turbine engine starter motor, illustrated in FIG. 2, includes a turbine scroll 20 and a gear casing 22. A turbine wheel 24 is mounted on a turbine shaft 26 and journaled in bearings in the gear casing. A spur gear 28 is splined onto the opposite end of the turbine shaft from the turbine wheel 24. The spur gear 28 is coupled through a gear train generally designated 30 to the starter motor output shaft 32. The output shaft 32 carries a spur gear 34 in turn coupled to the gear train 36 encased by the gear housing 12 (FIG. 1) on the turbine engine.

Fluid for powering the starter motor, typically pressurized air from a source external to the engine such as a ground supply unit or from the compressor section of another turbine engine is supplied via a conduit 38 to the turbine scroll 20. The air passes from the scroll into the turbine chamber 40 through a plurality of circumferential air inlets 42. The pressurized air travels through the blades 44 of the turbine wheel 24 causing it to rotate and drive the output shaft 34 of the starter motor. The pressurized air then exhausts axially outwardly or rearwardly relative to the rotational axis of the turbine wheel through an exhaust duct 46 formed integrally with the fan scroll 20. The exhaust duct 46 has a diameter less than the tip diameter of the turbine wheel 24.

Referring now to both FIGS. 2 and 3, the turbine wheel containment shroud 18, in its preferred form has a frusto-conically shaped, generally annular body that extends axially outwardly from the exhaust duct 46. The shroud 18 is manufactured from a metal such as stainless steel or high strength aluminum alloy and has a wall thickness substantially the same as that of the exhaust duct 46. The smaller diameter, inner end of the shroud 18 is positioned adjacent the outlet opening from the exhaust duct and has an inner opening having a diameter substantially the same as the inner diameter of the outlet opening of the exhaust duct 46. The body 50 of the shroud flares radially outwardly to an outer opening as the body extends axially outwardly or rearwardly from the exhaust duct 46 to form an expansion chamber for fluid being exhausted from the exhaust duct 46. Both the outer and inner openings of the shroud 18 are oriented transversely, and preferably perpendicularly to the axial dimension of the shroud. Thus, the shroud forms a rearward extension of the exhaust duct 46 that because of its shape and positioning does not create any fluid back pressure on the starter motor during normal operation.

A radially outwardly projecting annular shoulder 52 is permanently affixed, either by integral forming or by welding a separately formed shoulder member, to the inner end of the shroud body 50. The shoulder 52 on the shroud 18 mates with an attachment shoulder 54 normally provided on the exhaust duct 46 and surrounding the outlet opening from the exhaust duct. A conventional, commercially available clamp such as a marmon clamp 56 securely couples the shroud shoulder 52 and thus the containment shroud 18 to the exhaust outlet shoulder 54 and thus to the starter motor 10. If desired, a screen 58 can be interposed in the annular cavity provided within the shoulders 54 and 52 to prevent foreign objects from being inserted inwardly into the turbine wheel housing and fan scroll.

Still referring to FIGS. 2 and 3, a relatively small, massive member in the form of a cylindrical button 60 is positioned centrally within the outer outlet opening 62 of the shroud body 50. The button 60 is fixed in its central location within the outlet opening 62 of the shroud by four radially extending bars 64 circumferentially spaced at 90° locations around the button. The inner ends of the bars 64 are fixed to the periphery of the button 60 while the outer ends of the bars are fixed to the inner surface of the wall of the shroud body adjacent the outlet opening 62. The bars can be fixed to the button and to the wall of the deflector by conventional means such as welding. The diameter of the button 60 is relatively small compared with the inside diameter of the outlet opening 62 of the shroud to leave a substantial flow area through the deflector for fluid being exhausted from the exhaust duct of the starter. The space between the bars, the button and the wall of the deflector 50 is, however, sufficiently small to prevent a turbine wheel expelled through the exhaust duct from exiting from the shroud 18.

Circumferentially spaced, radially outwardly opening apertures 66 are located in the wall of the body 50 of the shroud 18 adjacent the shroud shoulder 52. The apertures 66 are located sufficiently close to the exhaust opening from the exhaust duct 46 and are spaced inwardly a sufficient distance from the shroud outlet opening 62 so that pressurized fluid being fed to the turbine scroll 20 can exit radially outwardly from the deflector even though an expelled turbine wheel 24 is located within and partially blocking the outlet opening of the shroud. Additional apertures 68 in the body 50 spaced between the shroud shoulder 52 and the shroud outer opening 62 are also provided to allow radial escape of pressurized fluid should the turbine wheel become lodged within the deflector 50 at a location other than directly against the button 60.

As discussed above, a prolonged free run condition of the turbine wheel 24 can cause bearing failure and/or turbine shaft shear, resulting in expulsion of the turbine wheel at a high rotational velocity through the exhaust duct 46 of the motor 10, as illustrated in FIG. 4. When the turbine shaft 26 disengages from the failed bearings, the outer peripheral portions of the turbine blades 44 contact the inner walls of the turbine chamber normally surrounding the turbine wheel. The heat energy generated by the scrubbing action of the turbine blades 44 against the scroll walls causes deformation and melting of the turbine blades 44. When the diameter of the turbine blades 44 is reduced sufficiently the free spinning turbine wheel 24 can move axially through the exhaust duct 46. The axial expulsion velocity of the turbine wheel is increased by the buildup of pressurized fluid behind the turbine wheel forcing it axially through the duct at a relatively high speed. As the turbine wheel 24 passes through the exhaust duct, it disintegrates the protective screen 58 and passes into the containment shroud 18. As it does so, the outer, central, butt end of the turbine wheel 24 contacts and scrubs against the button 60, causing a conversion of the rotational mechanical energy of the turbine wheel 24 into heat energy that is safely dissipated. In addition to the scrubbing action of the butt end of the turbine wheel against the button 60, the turbine wheel may begin to wobble relative to its normal rotational axis causing the outer or forward end of the blades 44 to scrub against the bars 64, dissipating additional mechanical energy. Moreover, the turbine wheel rather than staying centered within the containment shroud tends to roll about the inner surface of the shroud wall, further dissipating the mechanical energy of the wheel 24. When the turbine wheel is positioned toward the outer end of the shroud 18, a major portion of the outlet area from the outlet opening 62 of the deflector is blocked. Pressurized fluid still flowing into the fan scroll can escape first through the circumferential apertures 66 adjacent the exhaust opening from the exhaust duct 46, preventing a pressure buildup within the starter motor 10. As the turbine wheel 24 rolls about the interior of the shroud, the pressurized fluid can also escape from the central circumferential apertures 68. If the turbine wheel 24 becomes lodged at an angle so as to cover one or more of the inner circumferential apertures 66 and some of the central circumferential apertures 68, the diametrically opposed apertures 68 and 66 provide adequate area for exhaust of the pressurized fluid without creating backpressure within the starter motor.

In this manner, the containment shroud 18 of the present invention, although being relatively simple in construction and design, provides a significant improvement to pneumatically powered turbine engine starter motors. The potential damage not only to surrounding equipment but also to ground equipment and personnel that could result from the failure of the starter motor resulting in axial expulsion of the turbine wheel is virtually eliminated by the containment deflector, since the turbine wheel does not escape from the confines of the shroud. Although the containment shroud of the present invention has been described in conjunction with a preferred embodiment, one of ordinary skill in the art can make various alterations, substitutions of equivalents and changes without departing from the concepts disclosed herein. It is therefore intended that the scope of protection granted by Letters Patent be limited only by the definition contained in the appended claims.

What is claimed is:

1. A containment shroud for affixation to the exhaust duct of a fluid powered starter motor for a turbine engine, said exhaust duct including an exhaust outlet having an axis and a generally circular opening oriented transversely to said axis, said motor having a turbine wheel mounted within said motor for rotation about an axis substantially coaxial with the axis of said exhaust outlet, said shroud comprising:

an annularly shaped member, said member being adapted to be positioned adjacent to and to extend outwardly from the opening of said exhaust outlet, said member having an axis adapted to be oriented substantially coaxially with the axis of said exhaust outlet, said member having at least one aperture opening radially outwardly adjacent the opening of said exhaust outlet for relieveing fluid pressure from within said member and said exhaust outlet, the outer end of said member terminating in and defining an outer opening spaced outwardly from the opening of said exhaust outlet when said member is positioned adjacent said exhaust outlet, and blocking means positioned within and fixed to said annularly shaped member adjacent said outer opening, said blocking means being so oriented and constructed as to permit substantial fluid flow through said outer opening and to prevent egress of said turbine wheel from said outer opening.

2. The containment shroud of claim 1 wherein said member has an inner opening adapted to be positioned adjacent the opening of said exhaust outlet, said inner opening being generally circular and corresponding in size to the opening of said exhaust outlet, and wherein said member is radially flared relative to its axis from said inner opening to said outer opening.

3. The containment shroud of claim 1 wherein said annularly shaped member is frustoconically shaped and wherein said outer opening has a diameter greater than the diameter of said inner opening.

4. The containment shroud of claim 1 wherein said annularly shaped member has a plurality of apertures opening radially outwardly through said annularly shaped member adjacent said inner opening, said plurality of openings being circumferentially spaced about said annularly shaped member.

5. The containment shroud of claim 1 wherein said blocking means comprises at least one bar extending transversely across the said annularly shaped member.

6. The containment shroud of claim 5 wherein said bar is located inwardly from and adjacent to said outer opening.

7. The containment shroud of claim 6 wherein said blocking means further comprises:

at least a second bar extending transversely across the interior of said annularly shaped member adjacent to and spaced inwardly from said outer opening, said second bar oriented transversely to said first bar, and a massive central member mounted substantially coaxially relative to said annularly shaped member, said central member being affixed to said first and second bars at a central location within said annularly shaped member.

8. The containment shroud of claim 1 wherein said blocking means comprises a massive central member mounted substantially coaxially within said annularly shaped member adjacent to and spaced inwardly from the outer opening of said annularly shaped member, said central member having a transverse dimension less than the outer opening so as to permit egress of fluid through said outer opening, and means for affixing said central member to said annularly shaped member.

* * * * *